US011316276B2

(12) United States Patent
Flores-Cuadras

(10) Patent No.: US 11,316,276 B2
(45) Date of Patent: Apr. 26, 2022

(54) TRIFURCATED ANTENNA RADIATOR AND CIRCUITOUS TRANSMISSION LINE ASSEMBLY

(71) Applicant: 2J ANTENNAS USA, CORPORATION, Gilbert, AZ (US)

(72) Inventor: Javier Ruben Flores-Cuadras, Chandler, AZ (US)

(73) Assignee: 2J ANTENNAS USA, CORPORATION, Gilbert, AZ (US)

( * ) Notice: Subject to any disclaimer, the term of this patent is extended or adjusted under 35 U.S.C. 154(b) by 22 days.

(21) Appl. No.: 17/004,416

(22) Filed: Aug. 27, 2020

(65) Prior Publication Data

US 2021/0066809 A1 Mar. 4, 2021

Related U.S. Application Data

(60) Provisional application No. 62/892,362, filed on Aug. 27, 2019.

(51) Int. Cl.

| | |
|---|---|
| ***H01Q 13/20*** | (2006.01) |
| ***H01Q 21/06*** | (2006.01) |
| ***H01Q 5/47*** | (2015.01) |
| ***H01Q 21/30*** | (2006.01) |

(52) U.S. Cl.

CPC ..... *H01Q 13/206* (2013.01); *H01Q 5/47* (2015.01); *H01Q 21/068* (2013.01); *H01Q 21/30* (2013.01)

(58) Field of Classification Search

CPC ..... H01Q 13/206; H01Q 5/47; H01Q 21/068; H01Q 21/30; H01Q 1/38; H01Q 1/48; H01Q 9/42; H01Q 9/40

See application file for complete search history.

(56) References Cited

U.S. PATENT DOCUMENTS

| | | | | |
|---|---|---|---|---|
| 7,889,139 B2 * | 2/2011 | Hobson | ..... | H01Q 1/243 343/702 |
| 8,847,840 B1 * | 9/2014 | Diaz | ..... | H01Q 1/364 343/793 |

FOREIGN PATENT DOCUMENTS

| | | | | |
|---|---|---|---|---|
| CN | 202550066 U | * | 11/2012 | |
| CN | 206516764 U | * | 9/2017 | ..... H01Q 21/0006 |
| CN | 107335147 A | * | 11/2017 | |
| JP | 2015211425 A | * | 11/2015 | |
| WO | WO-2007136040 A1 | * | 11/2007 | ..... H02G 11/00 |

* cited by examiner

*Primary Examiner* — Vibol Tan

(74) *Attorney, Agent, or Firm* — CP Law Group PC; Cy Bates

(57) ABSTRACT

An antenna assembly includes a substrate, an antenna radiator and a circuitous transmission line. In various embodiments, a novel antenna radiator, a circuitous transmission line, and assemblies thereof are disclosed. The embodiments provide an antenna module that is optimized for wide band 5GNR frequencies (ex: 600 MHz to 6000 MHz) using a combined feeder extension of a serpentine RF coaxial cable and planar transmission line.

18 Claims, 7 Drawing Sheets

TRIFURCATED ANTENNA RADIATOR AND CIRCUITOUS TRANSMISSION LINE ASSEMBLY

CROSS-REFERENCE TO RELATED APPLICATIONS

This application claims benefit of priority with U.S. Provisional Application Ser. No. 62/892,362, filed Aug. 27, 2019; the entire contents of which are hereby incorporated by reference.

BACKGROUND

Field of the Invention

This invention relates to antennas; and more particularly, to an antenna module that is optimized for wide band 5GNR frequencies (ex: 600 MHz to 6000 MHz) using a combined feeder extension of a serpentine RF coaxial cable and planar transmission line.

Description of the Related Art

Optimal antenna performance is related to, among other things, the size of the ground plane associated with the corresponding antenna. The ideal size of the ground plane increases as the corresponding frequencies are lower. A method to electrically increase the size of the ground plane is known in the art by extending the transmission line. However, with spatial limitations inside an antenna housing, this method has limitations with optimal performance in the lower frequencies, for example the 600 MHz related to 5G. It would be beneficial in the art if the ground plane could be electrically increased without increasing the side of the antenna.

SUMMARY

The disclosure concerns an antenna assembly comprising a substrate, an antenna radiator and a circuitous transmission line. The circuitous transmission line is configured to couple to a feed of the antenna radiator. Furthermore, the circuitous transmission line is secured to the substrate with a plurality of connectors such that the circuitous transmission line forms a serpentine shape. This serpentine shape results in an electrical length that is greater than a dimensional length therewith.

Other advantages and benefits may be appreciated from the appended detailed descriptions.

BRIEF DESCRIPTION OF THE DRAWINGS

Other features, combinations, and embodiments will be appreciated by one having the ordinary level of skill in the art of antennas and accessories upon a thorough review of the following details and descriptions, particularly when reviewed in conjunction with the drawings, wherein.

DETAILED DESCRIPTION

Figure 1:
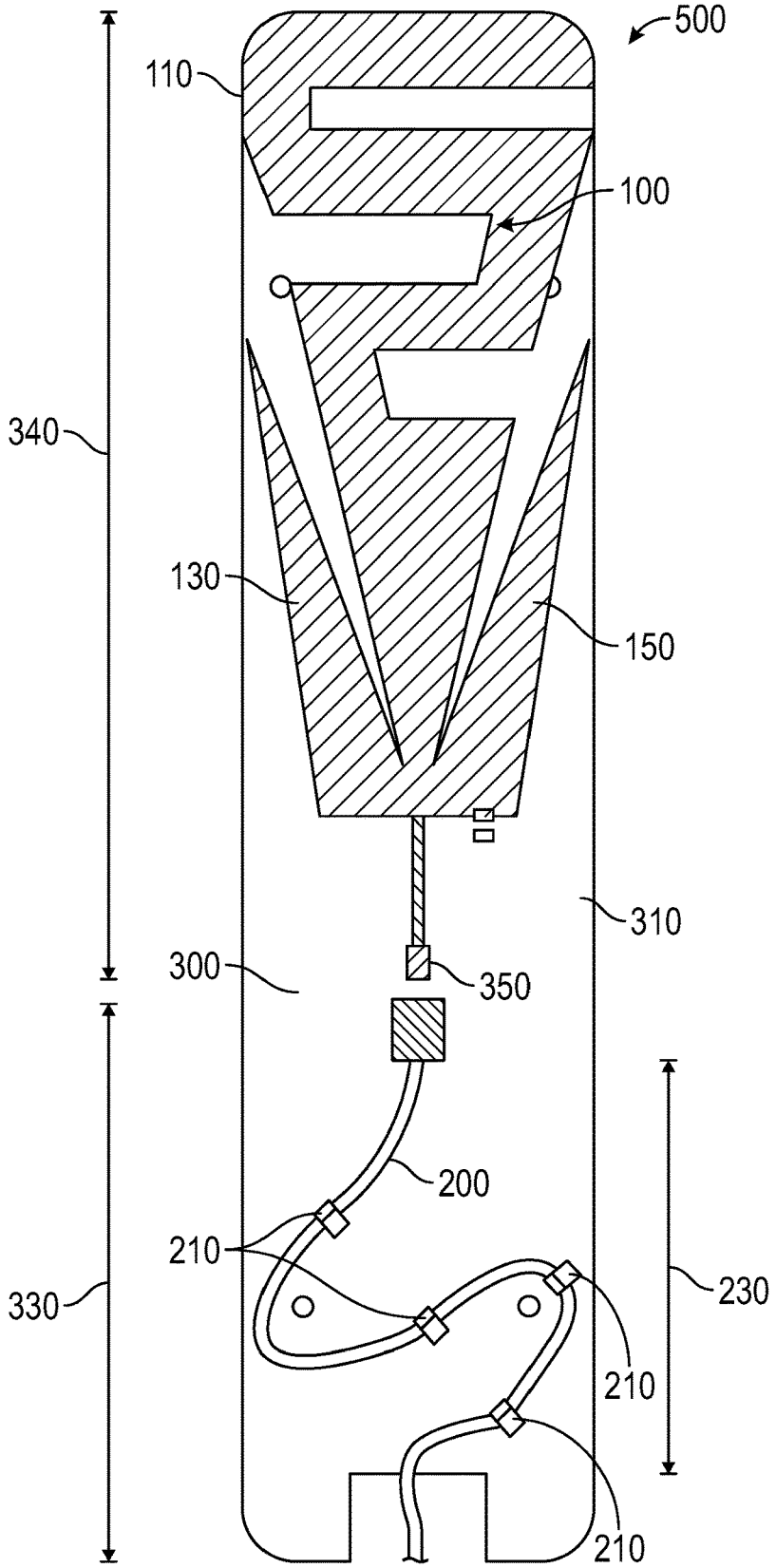
FIG. 1 shows a front view of the antenna module in accordance with a first embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

General Description of Embodiments

In a first embodiment, an antenna module is disclosed, the antenna module comprises a trifurcated antenna radiator, a circuitous transmission line, and a substrate. The trifurcated antenna radiator includes a monopole element, first tapered element and a second tapered element. The monopole element extends from a proximal end to a distal end. The first tapered element is coupled to the monopole element at the proximal end, and the first tapered element being configured to extend adjacent to the monopole element along a first side thereof. The second tapered element is coupled to the monopole element at the proximal end, and the second tapered element being configured to extend adjacent to the monopole element along a second side thereof, wherein the second side is opposite the first side. The circuitous transmission line is configured to couple to a feed of the trifurcated antenna radiator, and the circuitous transmission line is further configured to be secured to the substrate with a plurality of connectors for orienting the circuitous transmission line in a serpentine shape. The circuitous transmission line comprises an electrical length that is greater than a dimensional length associated therewith. The substrate comprises a first surface and a second surface, wherein each of the trifurcated antenna radiator and the circuitous transmission line is disposed on the first surface.

In the first embodiment the substrate of the antenna module may comprise a first longitudinal half and a second longitudinal half, wherein the circuitous transmission line is disposed on the first longitudinal half, and wherein the trifurcated antenna radiator is disposed on the second longitudinal half. While the terms "first longitudinal half" and "second longitudinal half" are provided, one with skill in the art will recognize that the word "half" is intended to be an approximation and not an exact measure; thus in some applications of the invention the "first longitudinal half" and "second longitudinal half" could be interchanged with "first longitudinal portion" and "second longitudinal portion", respectively.

In some embodiments, the substrate may comprise a plurality of holes such that the antenna module may be coupled to an antenna housing.

In the first embodiment, the antenna module further comprises a ground element. The ground element is disposed on the second surface of the substrate in the first longitudinal half thereof. The ground element may be configured to capacitively couple with the circuitous transmission line through the substrate.

In the first embodiment, the antenna module may further comprise a first tapered slot and a second tapered slot. The first tapered slot is disposed between the first tapered element and the monopole element at the first side. The second tapered slot is disposed between the second tapered element and the monopole element at the second side.

Generally, each of the first and second tapered slots may comprise a variable thickness relative to the monopole element, wherein the variable thickness is configured to increase in a direction from the proximal end to the distal end.

In the first embodiment, the monopole element may comprise a meander line portion.

In some embodiments, the monopole element is characterized as having a triangular form including an apex and a base opposite the apex. The apex is disposed at the proximal end.

In the first embodiment, each of the tapered elements may be individually oriented in a direction away from the monopole element.

In a second embodiment, an antenna is disclosed. The antenna comprises a trifurcated antenna radiator that includes a monopole element, a first tapered element and a second tapered element. The monopole element extends from proximal end to a distal end. The first tapered element is coupled to the monopole element at the proximal end and further configured to be extended adjacent to the monopole element along a first side. The second tapered element is coupled to the monopole element at the proximal end, and the second tapered element is configured to extend adjacent to the monopole element along a second side thereof, wherein the second side is opposite the first side.

In the second embodiment the antenna may further comprise a first tapered slot disposed between the first tapered element and the monopole element at the first side.

Additionally, in the second embodiment the antenna may further comprise a second tapered slot disposed between the second tapered element and the monopole element at the second side.

In the second embodiment, the first and second tapered slots may comprise a variable thickness relative to the monopole element. The variable thickness is configured to increase in a direction from the proximal end to the distal end.

In the second embodiment, the antenna of monopole element may comprise a meander line portion.

In the second embodiment, the monopole element may be characterized as having a triangular form including an apex, and a base opposite the apex, wherein the apex is disposed at the proximal end.

In the second embodiment, the tapered elements may each be individually oriented in a direction away from the monopole element.

In the second embodiment, the antenna may further comprise a ground element disposed adjacent to the trifurcated antenna radiator.

In a third embodiment, an antenna assembly is disclosed. The antenna assembly comprises a substrate, an antenna radiator and a circuitous transmission line. The antenna radiator is disposed on the substrate; and the circuitous transmission line is configured to couple to a feed of the antenna radiator. Furthermore, the circuitous transmission line is configured to be secured to the substrate with a plurality of connectors for orienting the circuitous transmission line in a serpentine shape, wherein the circuitous transmission line comprises an electrical length that is greater than a dimensional length associated therewith.

In the third embodiment, the circuitous transmission line in the serpentine shape may comprise two or more windings.

Generally, all sections of circuitous transmission line may be adjoined to the substrate as to minimize capacitive effects with the antenna radiator.

In some embodiments, the antenna assembly may include an antenna detection resistor. The antenna detection resistor is designed to be compatible with routers and corresponding antenna detection systems.

A function of the antenna module is to optimize the antenna performance at lower frequencies of 5GNR bands by efficiently utilizing the limited space within an antenna housing. Certain embodiments of the invention are further differentiated by a novel trifurcated antenna radiator configured to improve antenna performance. These and other embodiments make use of a circuitous transmission line to mimic a ground plane extension.

Manufacturing

Generally, the ground plane is made of industry standard material such as FR4, Kapton or Pyralux with printed circuit design affixed thereto. Otherwise, the ground plane can be fabricated in accordance with the level and knowledge of one having skill in the art. Other examples without limitation include more specialized materials such as Duroid, Taconic, and LDS.

The transmission line is made from coaxial cable which may be obtained commercially, for example and without limitation, ACX1589-ND on Digi-Key (https://www.digikey.com/product-detail/en/amphenol-rf/135103-02-12-00/ACX1589-ND/2003922). Alternatively, the transmission line can be customized in accordance with the level and knowledge of one having skill in the art. The transmission line includes connectors for the purpose of coupling the radio with the antenna element. The connections can be any combinations of SMA, W.FL., UFL or any other connections known in the art. Furthermore, each connection can be either Male or Female depending on both the radio and antenna element that the transmission line would couple.

The antenna radiator may be fabricated by etching the antenna element pattern in a metal conductor bonded to an insulating dielectric substrate, such as a printed circuit board.

Each of the components of the antenna module and related system described herein may be manufactured and/or assembled in accordance with the conventional knowledge and level of a person having skill in the art.

Definitions

For purposes herein the term "trifurcated" means a divide into three branches or forks.

The term "antenna radiator" means a conducting element of an antenna that is electrically connected to a radio receiver and/or a radio transmitter and which transmits and/or receives radio waves.

The term "circuitous" means a route, or routed in a path that is, longer than the most direct way.

The term "transmission line" means a device that couples a radio with an antenna.

The term "substrate" means a flat or nearly flat surface that contains a conducting portion and is part of the antenna.

The term "dimensional length" means the most direct distance between two end points.

Other terms not specifically defined herein should be construed in accordance with their plain and ordinary meaning as appreciated by one with skill in the art.

First Illustrated Embodiment

Now turning to the drawings, FIG. 1 shows a front view of an antenna module (500) according a first illustrated embodiment. The antenna module comprises a trifurcated antenna radiator (100), a circuitous transmission line (200) and a substrate (300). The substrate has a first surface (310) and a second surface (320, FIG. 2). The substrate can be further characterized as having a first longitudinal half (330) and a second longitudinal half (340). The trifurcated antenna radiator is disposed on the second longitudinal half and the circuitous transmission line is disposed on the first longitudinal half. The trifurcated antenna radiator comprises a monopole element (110), a first tapered element (130), and a second tapered element (150). Further description of the trifurcated antenna radiator is provided in FIG. 3 and FIG. 4. The circuitous transmission line is coupled to the trifurcated antenna radiator by a feed (350). Furthermore, the circuitous transmission line is attached to the first surface of the substrate with a plurality of connectors (210). The circuitous transmission line is oriented in such a manner that is has a dimensional length (230) that is always less than electrical length therewith.

Figure 2:
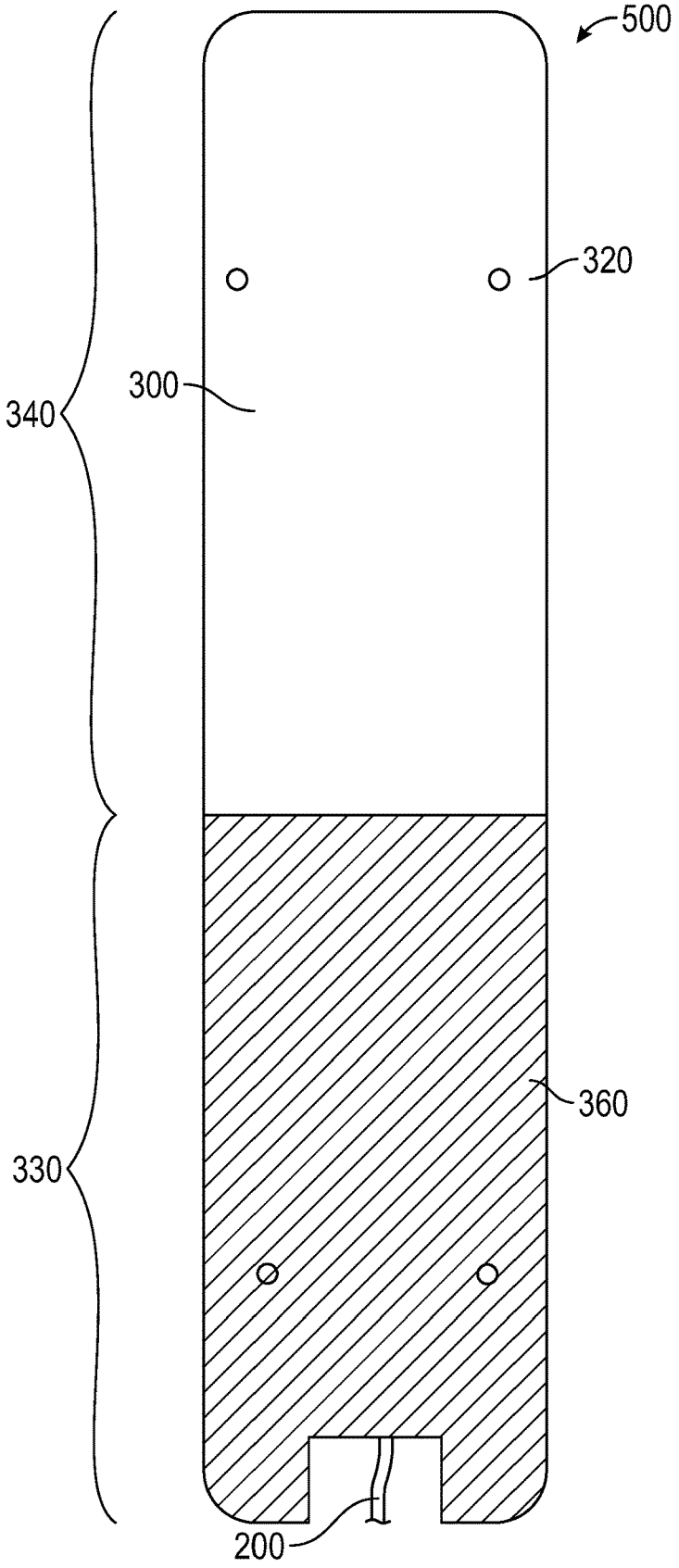
FIG. 2 shows a rear view of the antenna module in accordance with the first embodiment.

FIG. 2 shows a rear view of the antenna module (500) in accordance with the first illustrated embodiment. The antenna module comprises a substrate (300) and a ground element (360). The substrate has a first longitudinal half (330) and a second longitudinal half (340). The ground element is disposed on a second surface (320) of the substrate at the first longitudinal half. Furthermore, a circuitous transmission line (200) is partially shown, where it is couple to the substrate on a first surface (310).

Second Illustrated Embodiment

Figure 3:
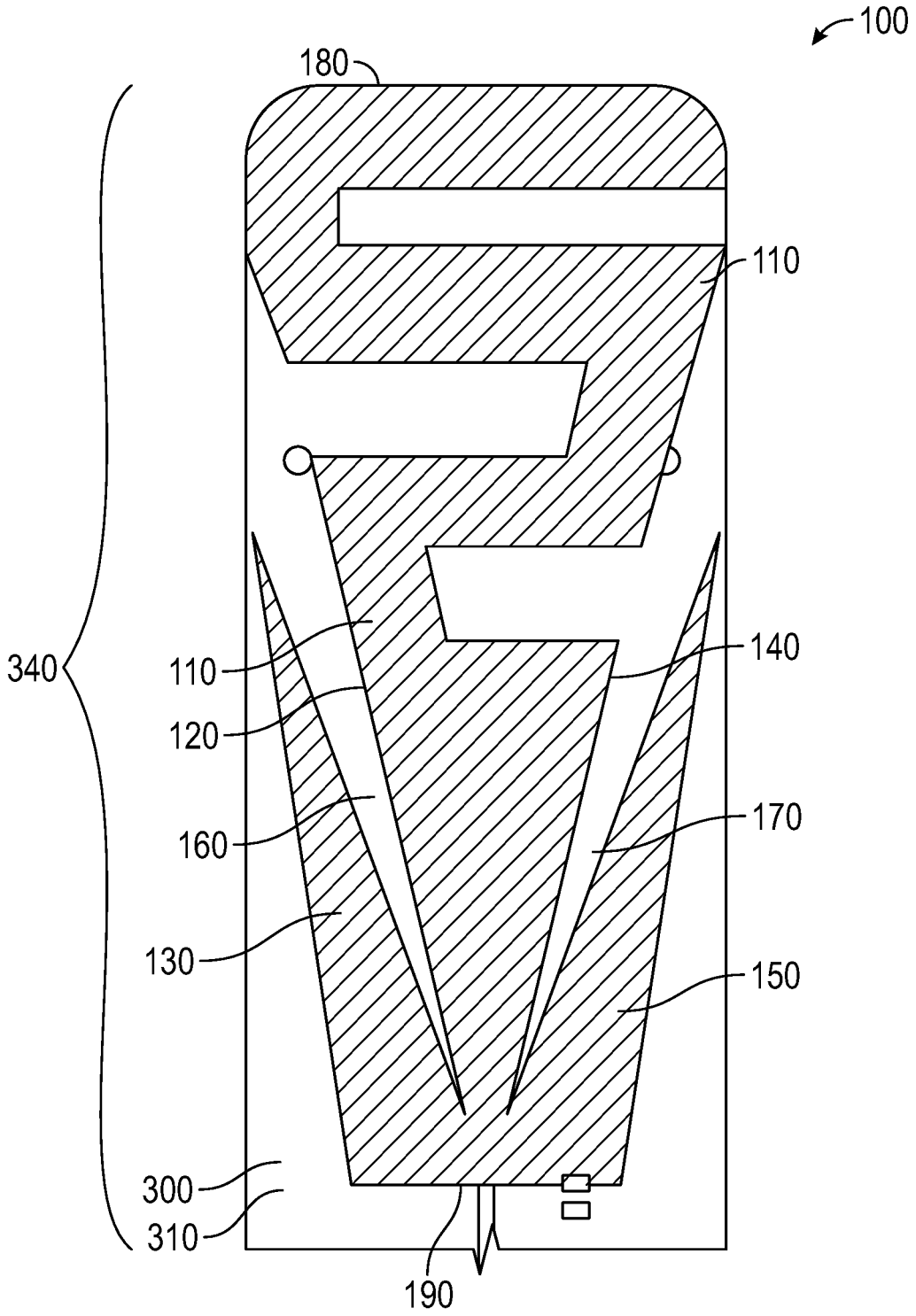
FIG. 3 shows a front view of the trifurcated antenna radiator in accordance with a second embodiment.

FIG. 3 shows a front view of the trifurcated antenna radiator (100) in accordance with a second illustrated embodiment. Here, the trifurcated antenna radiator is disposed on a substrate (300). The trifurcated antenna radiator comprises a monopole element (110), a first tapered element (130) and a second tapered element (150). The monopole includes a distal end (180) and a proximal end (190). Additionally, the monopole element has a first side (120) and a second side (140). The first tapered element is coupled to the first side of the monopole element at the proximal end. The second tapered element is coupled to second side of the monopole element at the proximal end. Furthermore, a first tapered slot (160) is disposed between the first side of the monopole antenna and the first tapered element. A second tapered slot (170) is disposed between the second side of the monopole element and the second tapered element. The first tapered slot and second tapered slot each comprise a variable thickness that increases in the direction away from the proximal end.

Figure 4:
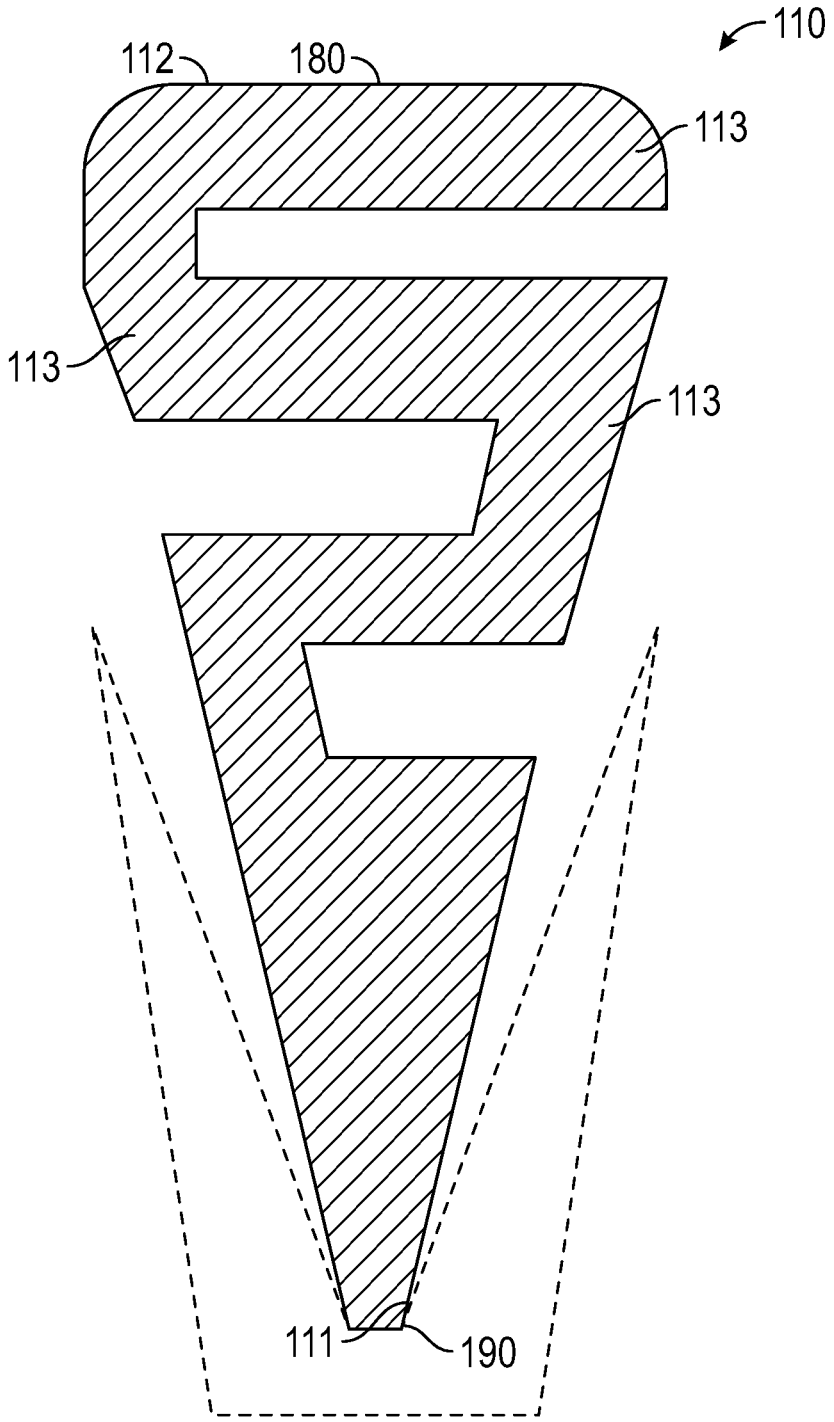
FIG. 4 shows a front view of the monopole element in accordance with the second embodiment.

FIG. 4 Shows a front view of the monopole element (110) in accordance with the second illustrated embodiment. The monopole element has a proximal end (190) and a distal end (180). The monopole element is characterized as having a triangular form with an apex (111) located at the proximal end and a base (112) located at the distal end. The monopole element includes a meander line portion (113) as shown. The first and second tapered elements are represented in broken lines to distinguish from the monopole element of FIG. 4.

Third Illustrated Embodiment

Figure 5:
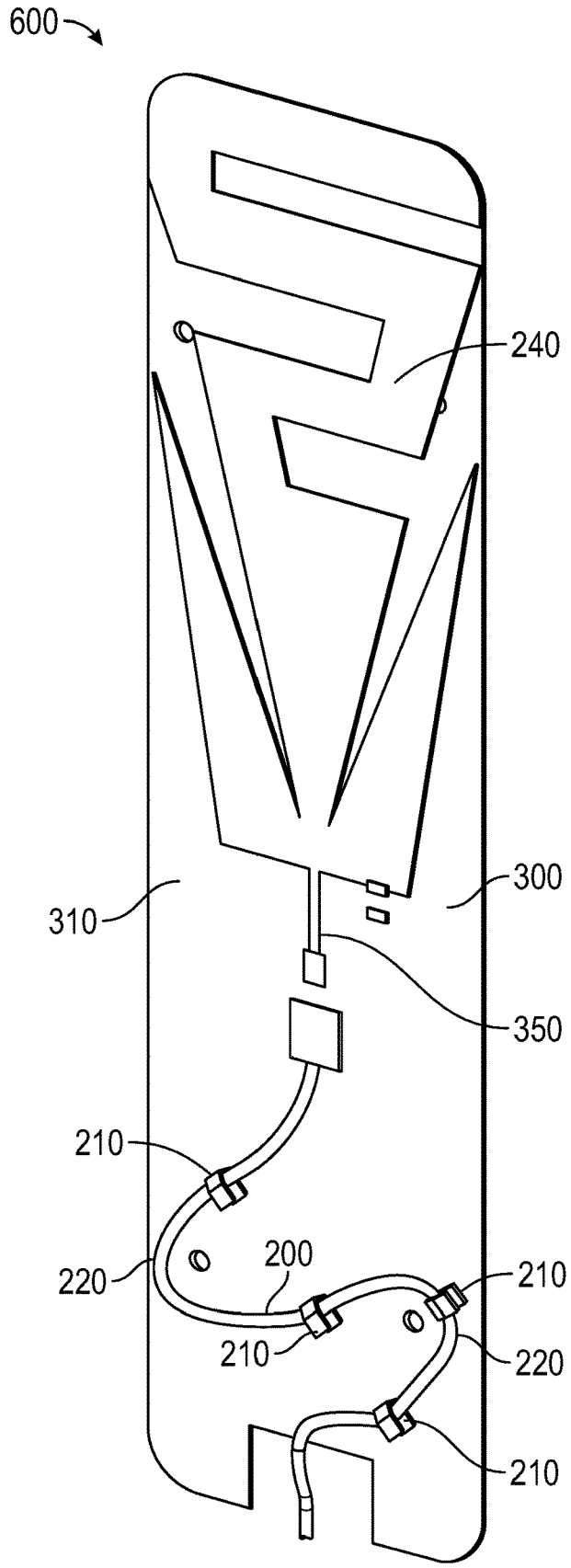
FIG. 5 shows an isometric view of the antenna assembly in accordance with a third embodiment.

FIG. 5 shows an isometric view of an antenna assembly (600) in accordance with a third embodiment. The antenna assembly comprises an antenna radiator (240) a circuitous transmission line (200) both disposed on a substrate (300). More specifically, the antenna radiator and circuitous transmission line are disposed on a first surface (310) of the substrate. The circuitous transmission line is coupled to a feed (350), and subsequently the feed is couple to the antenna radiator. The circuitous transmission line is attached to the substrate with a plurality of connectors (210). The plurality of connectors forms the circuitous transmission line into a serpentine shape comprising of multiples windings (220). While a trifurcated antenna element is shown, it will be appreciated by one having skill in the art that one of a myriad of possible antenna elements may be similarly implemented in this third illustrated embodiment in combination with the circuitous transmission line to achieve similar effects of the invention.

Figure 6:
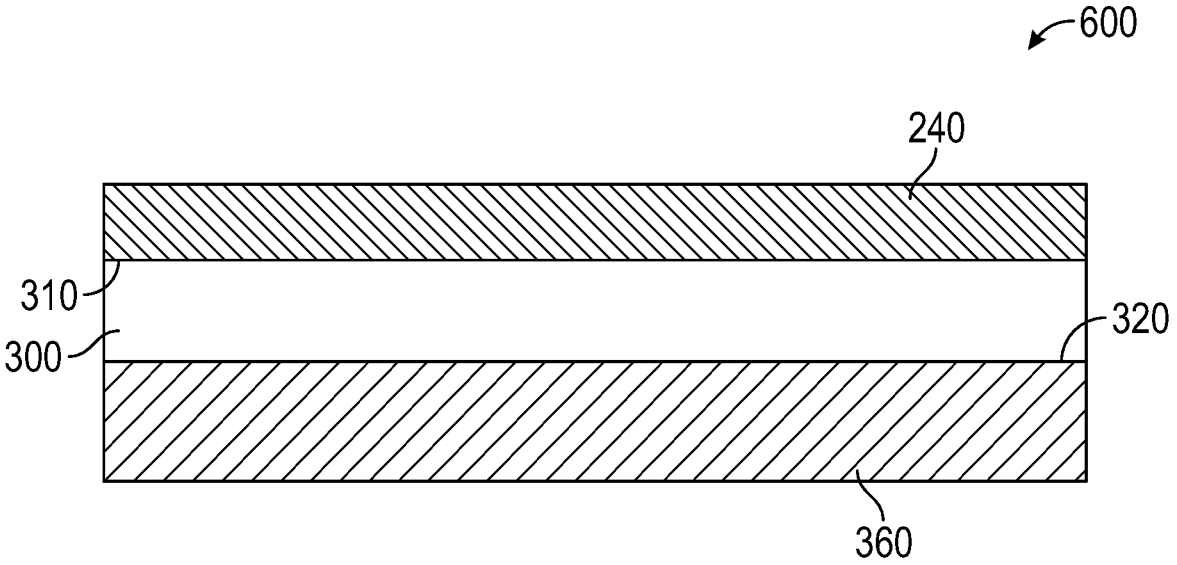
FIG. 6 shows a top view of the antenna assembly in accordance with the third embodiment.

FIG. 6 shows a top view of the antenna assembly (600) in accordance with a third embodiment. This view shows the antenna assembly comprising an antenna radiator (240), a substrate (300), and a ground plane (360). The antenna radiator is disposed on the substrate at a first surface (310), and the ground plane is disposed on the substrate (300) at a second surface (320). It will be appreciated by those with having knowledge and skill in the art that the antenna radiator and the ground plane may be on located on different portions of the substrate, more specifically a first longitudinal half (330, FIG. 1) and a second longitudinal half (340, FIG. 1).

Figure 7:
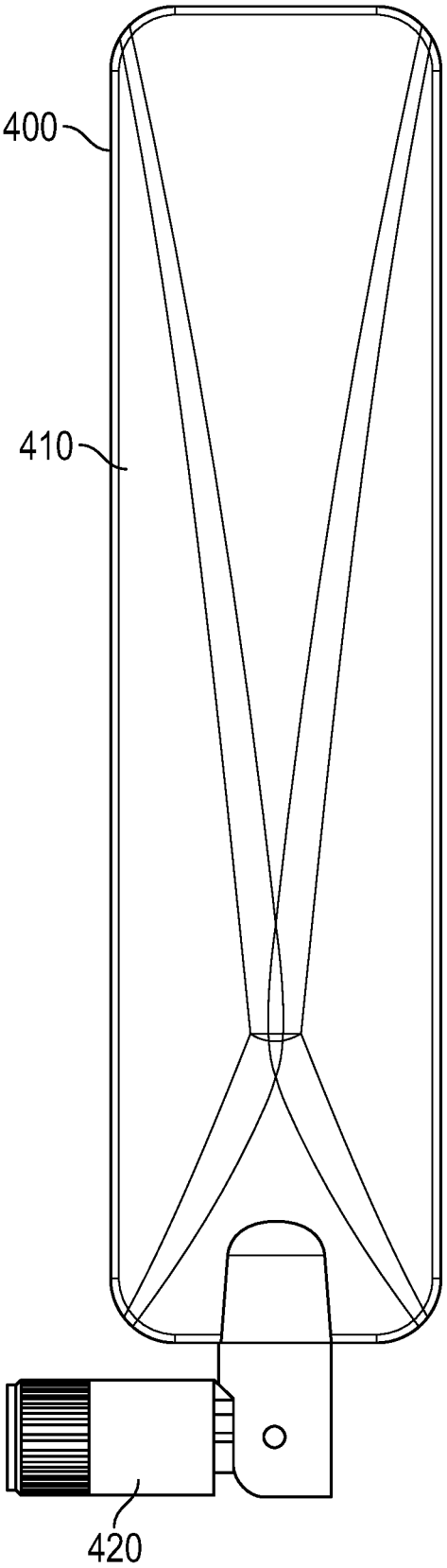
FIG. 7 shows a profile view of a paddle antenna in accordance with any of the first through third embodiments.

FIG. 7 shows a profile view of a paddle antenna (400) in accordance with any of the first through third illustrated embodiments, or any variation thereof. The paddle antenna comprises a paddle antenna housing (410) and a paddle antenna connector (420). It will be appreciated by those having knowledge and skill in the art that an antenna assembly (600, FIG. 5) can be installed inside the paddle antenna housing. The paddle antenna connector is couple to a circuitous transmission (200, FIG. 5) of the antenna assembly.

Figure 8:
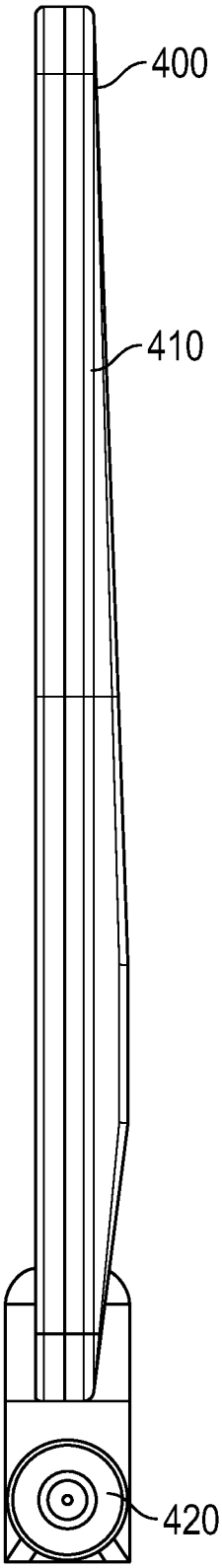
FIG. 8 shows a side view of a paddle antenna in accordance with any of the first through third embodiments.

FIG. 8 shows a side view of a paddle antenna (400) in accordance with any of the first through third embodiments. The paddle antenna comprises a paddle antenna housing (410), a paddle antenna connector (420), and an antenna assembly (600, FIG. 5). The antenna assembly further comprises a circuitous transmission line (200). The paddle antenna housing is configured to accommodate the antenna assembly with the paddle antenna housing. The paddle antenna connector is coupled to the paddle antenna housing and configured to couple to the circuitous transmission line.

FEATURE LIST trifurcated antenna radiator (100)
circuitous transmission line (200)
substrate (300)
monopole element (110)
first side (120)
first tapered element (130)
second side (140)
second tapered element (150)
first taper slot (160)

second taper slot (170)
distal end (180)
proximal end (190)
apex (111)
base (112)
meander line portion (113)
plurality of connectors (210)
windings (220)
dimensional length (230)
antenna radiator (240)
first surface (310)
second surface (320)
first longitudinal half (330)
second longitudinal half (340)
feed (350)
ground element (360)
paddle antenna (400)
paddle antenna housing (410)
paddle antenna connector (420)
antenna module (500)
antenna assembly (600)

What is claimed is:

1. An antenna module, comprising:
a trifurcated antenna radiator, the trifurcated antenna radiator including:
a monopole element extending from a proximal end to a distal end,
a first tapered element,
the first tapered element being coupled to the monopole element at the proximal end, and
the first tapered element being configured to extend adjacent to the monopole element along a first side thereof,
a second tapered element,
the second tapered element being coupled to the monopole element at the proximal end, and
the second tapered element being configured to extend adjacent to the monopole element along a second side thereof, wherein the second side is opposite the first side;
a circuitous transmission line,
the circuitous transmission line configured to couple to a feed of the trifurcated antenna radiator, and
the circuitous transmission line further configured to be secured to a substrate with a plurality of connectors for orienting the circuitous transmission line in a serpentine shape;
wherein the circuitous transmission line comprises an electrical length that is greater than a dimensional length associated therewith; and
the substrate comprising first surface and a second surface, wherein each of the trifurcated antenna radiator and the circuitous transmission line is disposed on the first surface.

2. The antenna module of claim 1, wherein the substrate comprises a first longitudinal half and a second longitudinal half, wherein the circuitous transmission line is disposed on the first longitudinal half, and wherein the trifurcated antenna radiator is disposed on the second longitudinal half.

3. The antenna module of claim 1, further comprising a ground element, wherein the ground element is disposed on the second surface of the substrate in the first longitudinal half thereof.

4. The antenna module of claim 1, further comprising: a first tapered slot disposed between the first tapered element and the monopole element at the first side; and a second tapered slot disposed between the second tapered element and the monopole element at the second side.

5. The antenna module of claim 4, wherein each of the first and second tapered slots comprises a variable thickness relative to the monopole element, wherein the variable thickness is configured to increase in a direction from the proximal end to the distal end.

6. The antenna module of claim 1, wherein the monopole element comprises a meander line portion.

7. The antenna module of claim 1, wherein the monopole element is characterized as having a triangular form including an apex and a base opposite the apex.

8. The antenna module of claim 7, wherein the apex is disposed at the proximal end.

9. The antenna module of claim 1, wherein each of the tapered elements is individually oriented in a direction away from the monopole element.

10. An antenna, comprising:
a trifurcated antenna radiator, the trifurcated antenna radiator including:
a monopole element extending from a proximal end to a distal end,
a first tapered element,
the first tapered element being coupled to the monopole element at the proximal end, and
the first tapered element being configured to extend adjacent to the monopole element along a first side thereof,
a second tapered element,
the second tapered element being coupled to the monopole element at the proximal end, and
the second tapered element being configured to extend adjacent to the monopole element along a second side thereof, wherein the second side is opposite the first side.

11. The antenna of claim 10, further comprising a first tapered slot disposed between the first tapered element and the monopole element at the first side.

12. The antenna of claim 11, further comprising a second tapered slot disposed between the second tapered element and the monopole element at the second side.

13. The antenna of claim 12, wherein each of the first and second tapered slots comprises a variable thickness relative to the monopole element, wherein the variable thickness is configured to increase in a direction from the proximal end to the distal end.

14. The antenna of claim 10, wherein the monopole element comprises a meander line portion.

15. The antenna of claim 10, wherein the monopole element is characterized as having a triangular form including an apex and a base opposite the apex.

16. The antenna of claim 15, wherein the apex is disposed at the proximal end.

17. The antenna of claim 10, wherein each of the tapered elements is individually oriented in a direction away from the monopole element.

18. The antenna of claim 10, wherein the antenna further comprises a ground element disposed adjacent to the trifurcated antenna radiator.

* * * * *